United States Patent [19]

Reagan et al.

[11] 4,384,949

[45] May 24, 1983

[54] PRETREATING HYDROCARBON FEED STOCKS USING DEACTIVATED FCC CATALYST

[75] Inventors: William J. Reagan, Englishtown; John W. Byrne, Saddle Brook; Francis L. Himpsl, Matawan, all of N.J.

[73] Assignee: Engelhard Minerals & Chemicals Corporation, Edison, N.J.

[21] Appl. No.: 257,849

[22] Filed: Apr. 27, 1981

[51] Int. Cl.[3] ..... C10G 25/09; B01J 29/06; C10G 25/12

[52] U.S. Cl. ..... 208/91; 208/251 R; 208/299; 208/310 Z; 252/455 Z

[58] Field of Search ..... 208/91, 251 R, 299, 208/310 Z, 120

[56] References Cited

U.S. PATENT DOCUMENTS

| | | | |
|---|---|---|---|
| 2,378,531 | 6/1945 | Becker | 208/91 |
| 2,432,644 | 12/1947 | Alther | 208/91 |
| 2,461,958 | 2/1949 | Bonnell | 208/74 |
| 2,521,757 | 12/1950 | Smith | 208/74 |
| 2,605,214 | 7/1952 | Galstaun | 208/91 |
| 2,614,068 | 10/1952 | Healy et al. | 208/78 |
| 2,689,825 | 9/1954 | McKinley | 208/91 |
| 2,761,821 | 9/1956 | Jahnig | 208/91 |
| 2,944,002 | 7/1960 | Faulk | 208/91 |
| 2,956,004 | 10/1960 | Conn et al. | 208/91 |
| 4,243,514 | 1/1981 | Bartholic | 208/299 |
| 4,309,274 | 1/1982 | Bartholic | 208/251 R |

*Primary Examiner*—Delbert E. Gantz
*Assistant Examiner*—O. Chaudhuri
*Attorney, Agent, or Firm*—Inez L. Moselle

[57] ABSTRACT

Whole crude and residual fractions from distillation of petroleum and like feed stocks are subjected to selective vaporization to prepare heavy fractions of reduced Conradson Carbon and/or metals content by short-term, high temperature riser contact with a substantially inert solid contact material of low surface area in a selective vaporization zone. High boiling point components of the charge which are of high Conradson Carbon number and/or high metal content remain on the contact material as a combustible deposit which is then burned off in a combustion zone whereby the contact material is heated to a high temperature for return to the selective vaporization zone to supply the heat required therein. Equilibrium FCC catalyst, previously treated to reduce catalytic cracking activity and surface area, is used as the substantially inert solid.

15 Claims, 2 Drawing Figures

PRETREATING HYDROCARBON FEED STOCKS USING DEACTIVATED FCC CATALYST

BACKGROUND OF THE INVENTION

This invention relates to the process for pretreating hydrocarbon feed stocks that is described in U.S. Pat. No. 4,243,514 to David B. Bartholic, entitled "Preparation of FCC Charge from Residual Fractions." The entire disclosure of that patent is incorporated herein by cross-reference thereto. This invention particularly relates to a novel catalytically inert (or substantially inert) fluidizable solid that is derived from equilibrium fluid cracking catalyst particles and to the use of such material as a contact agent in the process for pretreating hydrocarbon feed stocks that is described in the aforementioned Bartholic patent.

In U.S. Pat. No. 4,243,514, a process is described for increasing the portion of heavy petroleum crudes which can be utilized as the hydrocarbon feed stocks for fluid catalytic cracking ("FCC") processes to produce premium petroleum products, particularly motor gasoline of high octane number or high quality heavy fuel. The heavy ends of many crudes are high in Conradson Carbon residues (sometimes reported as Ramsbottom Carbon residues) and metal values, such as nickel and vanadium, as well as salts, such as sodium salts, which are undesirable in FCC feed stocks and in products such as heavy fuel. The process of U.S. Pat. No. 4,243,514 provides an economically attractive method for selectively removing and utilizing these undesirable components from whole crudes, as well as from the bottom fractions or residues of atmospheric and vacuum distillations of whole crudes, commonly called atmospheric and vacuum residua or "resids". In this regard, terms such as "residual stocks" and "resids" are used in a somewhat broader sense than is usual to include any petroleum fraction remaining after fractional distillation of petroleum to remove some of its more volatile components. In that sense, "topped crude", remaining after distilling off gasoline and lighter fractions, is a resid. The undesirable high Conradson Carbon (low hydrogen content) compounds, such as polynuclear aromatic compounds, and metal-containing compounds, as well as salts, present in crudes (e.g., whole crudes or resids) tend to be concentrated in the resids because most of them have low volatility.

When first introduced to the petroleum industry in the 1930's, the FCC process constituted a major advance over previous processes for increasing the yield of motor gasoline from petroleum to meet ever increasing demands. The FCC process was adapted to produce abundant yields of high octane naphtha from petroleum fractions boiling above the gasoline range, upwards of about 400° F. Greatly improved FCC process have since been developed by intensive research efforts, and plant capacity has expanded rapidly up to the present, so that the catalytic cracker is today the dominant unit or "workhorse" of a petroleum refinery.

As installed capacity of FCC processes has increased, there has been increasing pressure to charge, as feed stocks to FCC units, greater proportions of crudes. However, two major factors have opposed that pressure, namely, the Conradson Carbon residues and metal values in the crudes. As the Conradson Carbon residues and metal values have increased in crudes charged to FCC processes, capacity and efficiency of catalytic crackers have been adversely affected. Also, the quality of heavy fuels, such as Bunker Oil and heavy gas oil, produced by FCC processes has also been adversely affected as it has become necessary to make these fuels from crudes of high Conradson Carbon residues and high metal values.

The effect of high Conradson Carbon residues in hydrocarbon feed stocks for FCC processes has been to increase the portion of the feed stocks converted to "coke" deposits on the FCC catalysts. As coke has built up on the FCC catalyst, the active surfaces of the catalysts have been masked and rendered inactive for the desired catalytic cracking. It has been conventional practice to burn off the inactivating coke with air to "regenerate" the active surfaces, after which the catalysts have been returned in cyclic fashion to the reaction stage for contact with, and cracking of, additional feed stocks. The heat generated in the regeneration stage has been recovered and used, at least in part, to supply the heat of vaporization of the feed stocks and the endothermic heat of the cracking reaction. The regeneration stage has operated under a maximum temperature limitation to avoid heat damage to the catalysts. As the Conradson Carbon residues in feed stocks have increased, coke burning capacity has become a bottleneck which has forced a reduction in the rate of charging the feed stocks to FCC units. In additionm, part of the feed stocks has inevitably had to be diverted to undesirable reaction products.

Metal values, such as nickel and vanadium, in hydrocarbon feed stocks for FCC processes have tended to catalyze the production of coke and hydrogen in FCC units. Such metals also have tended to be deposited on FCC catalysts, as the molecules in which they occur in the feed stocks are cracked, and to build up on the catalysts. This has further increased coke production with its accompanying problems. Excessive hydrogen production also has caused a bottle-neck problem in processing lighter ends of cracked products through fractionation equipment to separate valuable components, primarily propane, butane and the olefins of like carbon number. Hydrogen, being incondensible in the "gas plant", has occupied space as a gas in the compression and fractionation train and has tended to overload the system when excessive amounts are produced by high metal content catalysts. Conventional practice is to withdraw equilibrium fluid cracking catalyst periodically from circulating catalyst inventory to maintain catalytic activity and selectivity at desired levels. Fresh catalyst is added to compensate for both withdrawn equilibrium catalyst and catalyst fines resulting from attrition of catalyst particles during use. Feed stocks high in metals generally necessitate high rates of withdrawal of equilibrium catalyst and/or reducton in feed stock charge rates to maintain FCC units and their auxiliaries operative.

These problems have long been recognized in the art, and many ways, discussed in U.S. Pat. No. 4,243,514, have been proposed to remove the high Conradson Carbon and metal-containing components from hydrocarbon feed stocks, such as resids, before they are used in FCC processes.

By the pretreatment process in U.S. Pat. No. 4,243,514, high Conradson Carbon and metal-containing components, as well as salts, can be economically removed from a hydrocarbon feed stock, containing the highest boiling components of a crude, before charging the feed stock to an FCC unit or a hydroprocessing unit.

In this pretreatment process, the feed stock is subjected to a selective vaporization step in which there is a high temperature, short hydrocarbon residence time contact in a confined rising vertical column between the feed stock and a hot fluidized solid contact material. The contact material serves as a heat transfer medium and acceptor of unvaporized material from the feed stock. The contact material is essentially inert in the sense that it has low catalytic activity for inducing cracking of the feed stock. There is an expressed preference for using contact material that has a much lower surface area relative to its weight than conventional FCC catalysts.

During the selective vaporization step, most of the feed stock is vaporized by the high temperature contact with the contact material. However, the majority of the high Conradson Carbon and metal-containing components of the feed stock, as well as salts in the feed stock, are not vaporized by the high temperature contact with the contact material but are instead deposited on the surface of the contact material. The contact material, on which the unvaporized portions of the feed stock have been deposited, is then subjected to a combustion step in which the combustible portions of the deposits on the contact material are oxidized to generate heat which is imparted to the contact material. The so-heated contact material is then recycled and contacted with additional feed stock. By this process, the heat required for the selective vaporization step is generated by oxidation of the combustible deposits on the contact material, including the combustible high Conradson Carbon and metal-containing components of the feed stock.

The Bartholic patent teaches that fluidizable solid contacting agent suitable for the selective vaporization step is essentially inert in the sense that it induces minimal cracking of heavy hydrocarbons by a standard microactivity test conducted by measurement of amount of gas oil converted to gas, gasoline and coke by contact with the solid in a fixed fluidized bed. Charge in that test is 0.8 grams of mid-Continent gas oil of 27° API contacted with 4 grams of catalyst during 48 second oil delivery time at 910° F. This results in a catalyst to oil ratio of 5 at weight hourly space velocity (WHSV) of 15. By that test, the solid employed in the process of U.S. Pat. No. 4,243,514 exhibits a microactivity less than 20, preferably about 10. The preferred fluidizable solids, according to the teaching of the patent, are microspheres of calcined kaolin clay. Other solids disclosed in the patent include low surface area forms of silica gel and bauxite. A variety of other solids of low catalytic activity are mentioned at col. 5. General criteria for selection include low cost, low catalytic activity, availability in the form of inert fluidizable particles and low surface area. The patent takes note of the fact that the desired low surface area is considerably below that of commercial fluid cracking catalysts.

As described in U.S. Pat. No. 4,243,514, decarbonized, demetallized resid is good quality hydrotreating, hydrocracking or FCC charge stock and may be transferred to the feed line of an FCC reactor operated in the conventional manner. Spent catalyst from the FCC reactor passes by a standpipe to a conventional FCC regenerator while cracked products leave reactor by transfer line to fractionation for recovery of gasoline and other conversion products. Hot regenerated FCC catalyst is transferred from an FCC regenerator by a standpipe for addition to the FCC reactor.

The economics of the selective vaporization process of U.S. Pat. No. 4,243,514 is dependent upon the cost, availability and performance characteristics of the inert fluidizable solid. When the selective vaporization step is carried out at a refinery site that includes one or more FCC units, equilibrium fluid cracking catalyst particles are made available when the material is withdrawn from the cracking units in order to maintain the activity and selectivity of the circulating cracking catalyst inventory at acceptable levels. Virtually all present refineries utilize zeolitic cracking catalysts. Properties and characterization of commercial zeolitic cracking catalysts appear in a monograph "Fluid Catalytic Cracking Catalysts," Paul B. Venuto and E. Thomas Habib, Jr., Vol. I, published by Marcel Dekker, Inc. pages 30–43 (1979).

Typical equilibrium zeolitic FCC catalysts are not suitable for use in the selective vaporization process of U.S. Pat. No. 4,243,514 because of their high residual level of cracking activity and high surface area. A comparison of representative fresh and equilibrium fluid zeolite FCC catalyst is reported in the monograph above cited at page 46. The equilibrium catalyst contained fairly low levels of metals (i.e., 259 ppm of V+Ni+Cu). Catalytic activity ("Microactivity") was 85% for the fresh zeolitic catalyst and 73% for equilibrium zeolitic catalyst; carbon and hydrogen factors were 0.6 and 0.2, respectively, for fresh catalyst and 0.6 and 0.7, respectively, for equilibrium catalyst. Surface area decreased from 335 to 97 $m^2/g$. when the fresh catalyst reached equilibrium state. Pore volume decreased from 0.60 to 0.45 $cm^3/g$.

While the equilibrium catalyst was less active and had lower surface area than did the fresh catalyst, the former material does not meet the performance criteria for a contact material for use in the process of the Bartholic patent. However, equilibrium catalyst does have desirable density and attrition-resistance and it finds use as the active contact material for starting-up FCC units which cannot tolerate the activity of fresh catalyst. However, in some refineries there is an excess of available equilibrium catalyst. Such excess may be supplied to other refineries for start-up. A notable exception is equilibrium catalyst in which the metals level is high, e.g., 1000 ppm V+Ni+Cu. These heavily contaminated catalysts are generally not useful for start-up. In effect such equilibrium catalyst is a waste material, finding utility as landfill or other low-value disposition.

Various suggestions have been made to divert either equilibrium cracking catalyst withdrawn from a catalyst regenerator or catalyst fines to other points in a refinery for the purpose of pretreating cracker feedstock in one way or another. Some pretreatments involve liquid-solid contact in a first stage carried out either under pressure or relatively low temperature to maintain feed stock in liquid state. For example, nitrogen bases, sulfur or salts are removed before feed stock is catalytically cracked. Other pretreatments, generally involving vapor-solid contact, utilize the minimized residual cracking activity of used catalyst in a first stage mild cracking operation. Reference is made to the following patents:

U.S. Pat. No. 2,944,002—Faulk
U.S. Pat. No. 2,689,825—McKinley
U.S. Pat. No. 2,614,068—Healy et al.
U.S. Pat. No. 2,605,214—Galstaum
U.S. Pat. No. 2,521,757—Smith
U.S. Pat. No. 2,541,267—Mills, Jr. et al.
U.S. Pat. No. 2,461,958—Bonnell
U.S. Pat. No. 2,378,531—Becker In the Smith patent, the activity of spent catalyst from a second stage cracking may be controlled if necessary by steaming or calcination before utilization in first stage cracking. However, the intent of patentee is to utilize the ability of spent catalyst to crack feed stock.

While equilibrium FCC catalyst from present day refineries would seem to provide a low cost source of fluidizable attrition resistant particles potentially useful in pretreating feedstocks by selective vaporization, the residual activity and, in most cases, high surface area, rule out this alternative. It is know that sodium compounds such as sodium chloride are poisons for FCC catalysts. Note the Becker patent, supra. Chloride salts, however, tend to increase coke make. Therefore, deactivation of equilibrium catalyst by addition of sodium chloride will result in a material that would be of limited use as the contact material in the pretreatment process of the Bartholic patent. Conversion of feed stock to coke would reduce the portion of feed stock constituting valuable FCC feedstock. Sodium hydroxide in FCC feedstock is also known to deactivate zeolitic cracking catalyst. We have found that addition of caustic to equilibrium catalyst particles followed by thermal treatment to sinter the particles may result in significant decrease in catalytic activity. However, coke make is high as compared to coke make using fluidizable particles of calcined kaolin clay unless high levels of caustic are used or extremely high calcination temperature is employed.

SUMMARY OF THE INVENTION

In accordance with this invention, fluidizable solid particles having properties useful in the practice of the selective vaporization step of U.S. Pat. No. 4,243,514 are obtained by treating fluid equilibrium zeolitic cracking catalyst particles to reduce both catalytic activity and surface area without introducing material that will increase carbon and/or hydrogen factors, preferably by treatment that materially reduces both carbon and hydrogen factors.

This is accomplished in accordance with the invention by addition to equilibrium cracking catalyst of a suitable sintering agent, for example sodium borate or sodium silicate, followed by heating at a temperature and time sufficient to achieve a desired decrease in cracking activity and reduction in surface area.

All or part of the equilibrium fluid cracking catalyst used as a starting material in carrying out the invention may be secured from the same refinery in which FCC reactor feed is pretreated by selective vaporization substantially as described in U.S. Pat. No. 4,243,514. In this case metals levels will usually be low. Alternatively, the source of equilibrium catalyst may be a different refinery.

In one embodiment of the invention a solution of treating reagent is applied to equilibrium catalyst which is heated in a furnace or calciner to effect the desired sintering. Sintered product is then used as new charge for the selective vaporizing contactor. In another and presently preferred embodiment, equilibrium catalyst with added sintering agent is charged directly to the burner associated with the contactor for conversion in situ into a material of reduced activity and surface area and suitable for discharge into the contactor and subsequent cycling between the contactor and the burner. In still another embodiment, the treating reagent is introduced as a solution into the burner, for example into the dilute upper phase of a burner and equilibrium catalyst, also introduced in the burner, is sintered in situ in the burner and is available as charge to the contactor.

By the process improvement, equilibrium cracking catalyst from an FCC unit may be used, after suitable deactivation as described herein, as all or a portion of the inert solid contacting agent. This simplifies the storage of equilibrium catalyst in a refinery and avoids the need to ship or, in some cases, to dispose of equilibrium catalyst. Use of eqiulibrium catalyst from the same refinery permits utilization of all or part of the heat content of equilibrium catalyst which would otherwise be wasted. On the other hand, the process permits use of heavily contaminated equilibrium catalyst from the same or a different refinery because the process of the invention may eliminate or substantially eliminate the normally adverse effects of metals such as nickel or vanadium on hydrogen and coke formation.

Also by the process improvement the selective vaporization step is carried out with minimal cracking of feed stock to form hydrogen and superfluous coke deposits on the contact material in spite of the fact that the precursor of the contact material (equilibrium catalyst) may be laden with metals that normally would induce formation of hydrogen and superfluous coke if used without pretreatment in the feedback vaporizing contactor.

Figure 2:
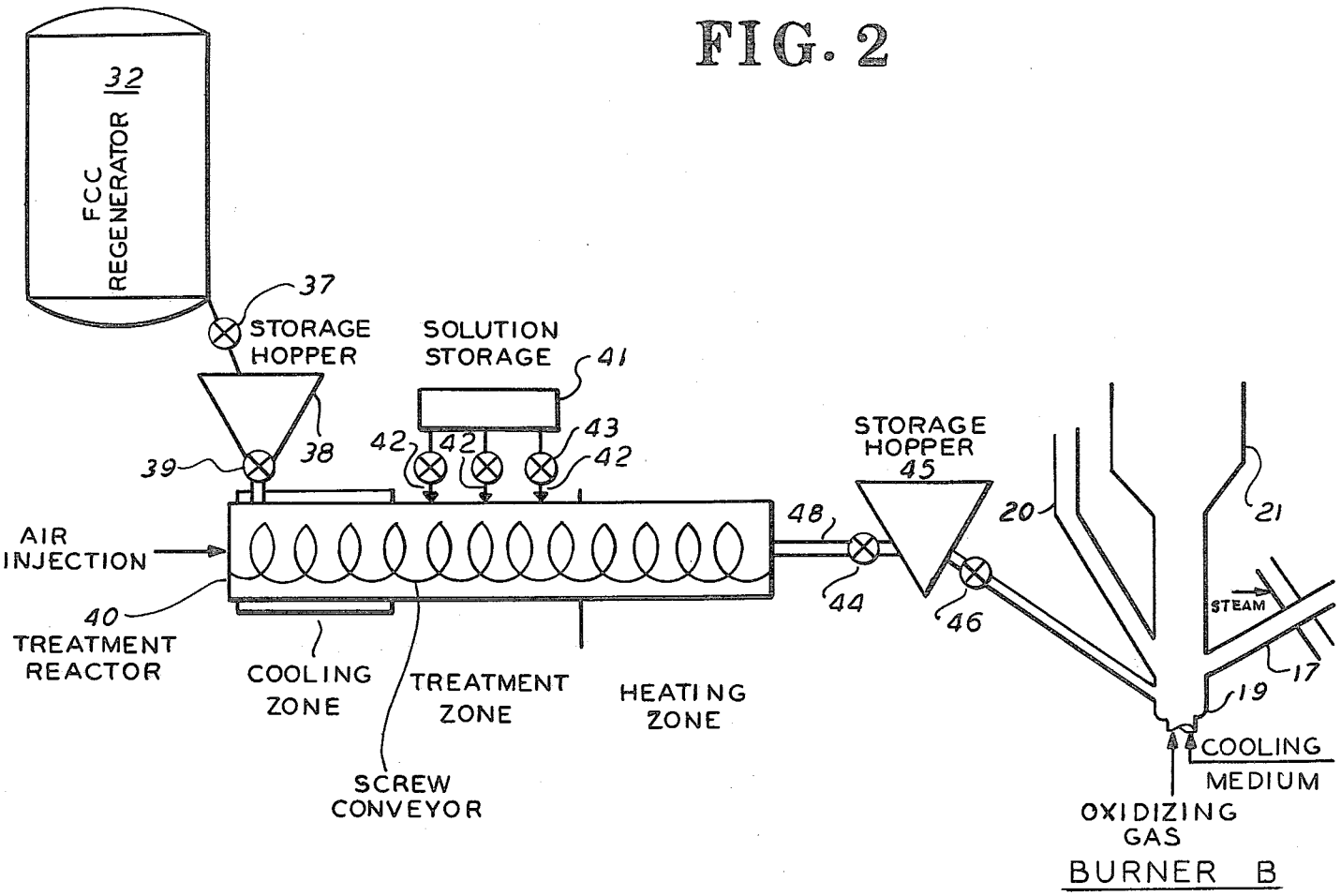

In the embodiment of the invention shown in FIG. 2, which represents the presently envisioned best mode of practicing our invention, equilibrium catalyst is treated with a solution of sintering agent and is deactivated in the presence of steam in the burner used to regenerate spent inert material from the selective vaporization zone.

DETAILED DESCRIPTION OF THE PREFERRED EMBODIMENT

Equilibrium zeolitic catalysts of widely varying characteristics are amenable for use in practice of the invention. The physical and chemical properties of equilibrium catalyst vary somewhat, depending inter alia on the composition of the fresh catalyst and the conditions prevailing in the operation of reaction, stripping and regeneration zones in the FCC unit. For example, refineries operating with feed stocks high in metals and utilizing low withdrawal rates, possibly implemented by use of so-called metal "passivators," may contain high levels of metals (e.g., 1000 ppm or more of combined nickel and vanadium). Other equilibrium catalyst may contain 200 ppm metals or less. Surface area of equilibrium catalyst may be influenced by the surface area of fresh catalyst. Typically, fresh catalysts have surface areas in the range of 100 to 250 $m^2/g$. (BET). Regenerator temperature and steam levels used in the FCC system affect the surface area of the equilibrium catalyst. Generally, equilibrium zeolitic fluid cracking catalysts have a surface area well above 75 $m^2/g$, more usually above 100 $m^2/g$. Activity by the MAT test described in the illustrative examples is usually appreciably above 60% conversion.

The choice of treatment of the equilibrium catalyst (sintering agent species, amount and sintering conditions) will be influenced by the activity and surface area of the available equilibrium catalyst. Generally the more active the material the greater the amount and/or the higher the temperature needed to effect sintering.

Preferred sintering agents are salts of alkali or alkaline earth metals, preferably sodium, and weak acids, for example boric, silicic and phosphoric acids. Water soluble salts are preferable. Examples include sodium borate, sodium phosphate and sodium silicate. In addition, other sintering agents are within the scope of this invention. For purposes of economy it is desirable to minimize the amount of sintering agent added to equilibrium catalyst. Generally, a sintering agent is employed in amount within the range of 1% to 20% by weight of equilibrium catalyst, all weights being based on a dry weight basis. For purposes of convenience the sintering agent may be added by impregnating a charge of fluidizable equilibrium catalyst with a solution of a suitable sintering agent, such as an alkali metal compound. Preferably a solution of sufficiently high concentration to wet the particles of equilibrium catalyst without forming a separate aqueous phase is utilized because this avoids the need to use filtration or other dewatering devices to remove liquid from impregnated particles of catalyst. It is within the scope of the invention, however, to slurry a supply of FCC equilibrium catalyst in a solution of sintering agent and then dewater the slurry before drying and sintering at elevated temperature.

In general, deactivation of the equilibrium catalyst as a result of sintering results in the destruction, partially or totally, of the zeolite component. However, mere destruction of the zeolite component without sintering will not produce the beneficial results realized when sintering also takes place. This is demonstrated in an illustrative example in which the zeolite component of an equilibrium FCC catalyst was destroyed by leaching with caustic solution under reflux conditions but without appreciable sintering occurring. Sodium hydroxide solution, added by impregnation, may be used as a sintering agent but high temperature sintering may be needed.

For reasons of economy sintering temperatures are preferably kept at a minimum. Generally sintering temperatures above 1200° F. are necessary and temperatures above about 2200° F. are avoided because of cost considerations. With most sintering agents, steam facilitates use of lower temperatures to accomplish a given desired reduction in activity and surface area for most sintering agents at constant levels of addition. Presently preferred is to sinter in an atmosphere containing steam at a minimum feasible temperature, preferably below 1800° F. and most preferably below 1500° F., for example 1250° F. to 1450° F.

Sintering of equilibrium zeolitic FCC catalyst particles results in a novel product, useful as a contact material in the selective vaporization of petroleum feed stock containing Conradson Carbon and metal-containing components and in some cases, salts. The product is in the form of attrition resistant, fluidizable microspheres having a surface area (BET method using $N_2$ as adsorbate) below about 50 $m^2/g$, preferably below about 10 $m^2/g$. Generally the sintered particles analyze from about 1% to 10% by weight of Na (or equivalent amount of other alkali metal). The presence of a crystalline zeolite is usually not detectable when the sintered microspheres are examined by conventional X-ray diffraction.

Especially preferred are sintered equilibrium catalysts which, under microactivity (MAT) tests conditions described in the illustrative examples, exhibit: a conversion below about 20% (wt), preferably about 15% (wt) or below, for example 5–15% (wt); and a coke yield below 1–50% (wt). Furthermore, the attrition resistance should preferably be at least as good as that of a commercial fluid cracking catalyst. Also the sintered catalysts must have a particle size distribution such that the material has adequate fluidization properties. In other words, the fluidization properties possessed by equilibrium catalyst prior to sintering should not be impaired prior to or during sintering. If agglomeration or aggregation does take place to an appreciable extent during sintering and/or if excessive fines are present, the sintered product should be classified by wet or dry means to assure that the sintered microspheres have satisfactory fluidization properties.

Figure 1:
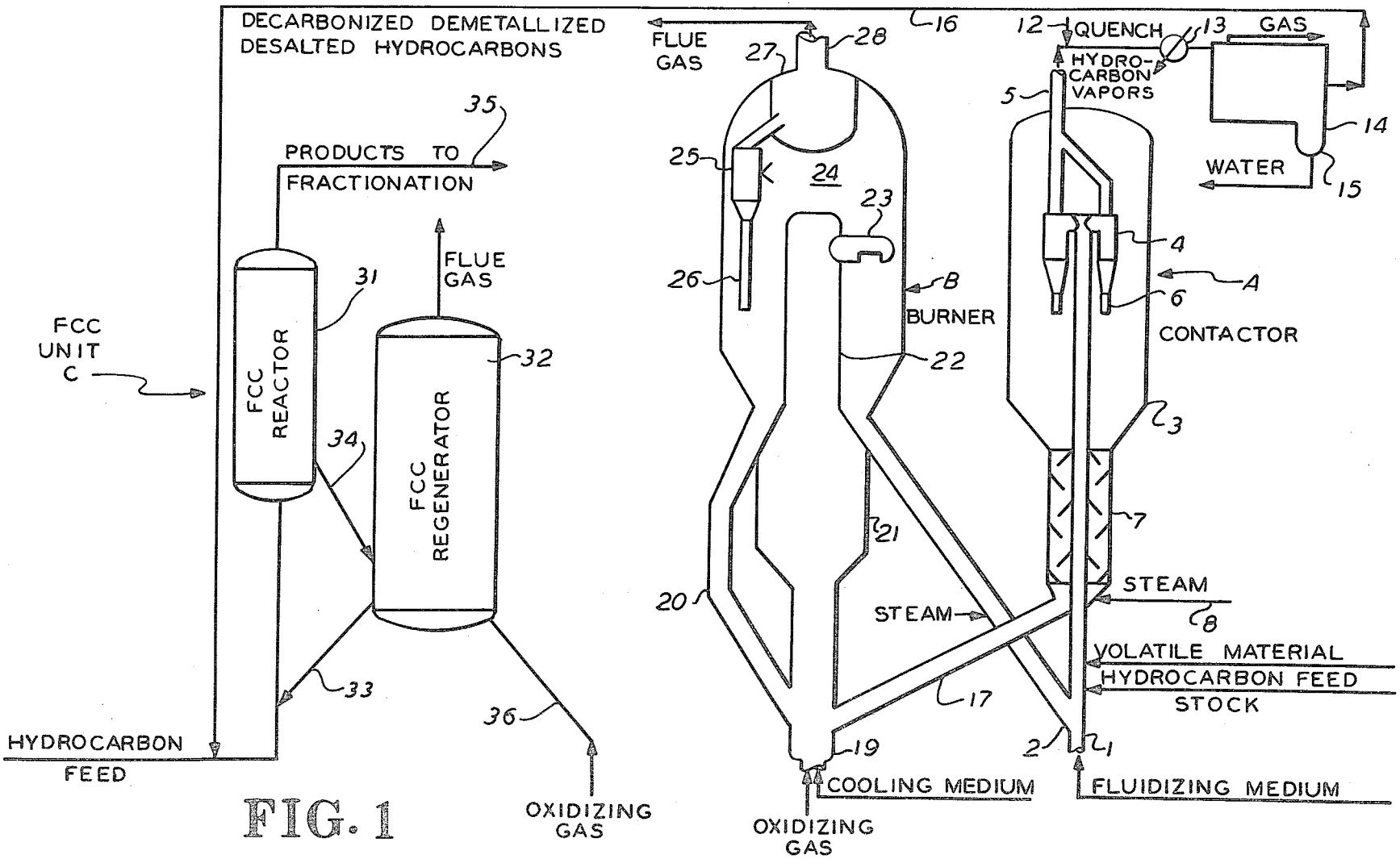
FIG. 1 is a schematic flow chart of the process for pretreating a hydrocarbon feed stock with a novel inert fluidizable solid derived from equilibrium fluid cracking catalyst particles and then charging the pretreated feed stock to an FCC process that serves as the source of the equilibrium cracking catalyst particles.

Shown in FIG. 1 are means for carrying out a pretreatment process for decarbonizing, demetallizing and/or desalting a hydrocarbon feed stock, such as a whole crude or a resid. The means for carrying out the pretreatment process include a contactor, generally A, for carrying out a selective vaporization step and a burner, generally B, for carrying out a combustion step.

In the selective vaporization step, the hydrocarbon feed stock is mixed in a confined rising vertical column or riser 1 in the contactor A, shown in FIG. 1, with an inert solid fluidizable contact material. The contact material is supplied to the riser, heated to a high temperature.

During the selective vaporization step, hydrocarbons in the feed stock are vaporized by the high temperature contact with the contact material in the riser 1 of contactor A. There is also sorption of the high Conradson Carbon components, metal-containing components (particularly those containing nickel and vanadium) and salts (e.g., sodium salts) of the feed stock on the surface of the contact material.

At the top of the riser 1, after vaporization of most of the hydrocarbons in the feed stock and sorption of its high Conradson Carbon and metal-containing components and salts by the contact material, the vaporous hydrocarbons are rapidly separated from the contact material. Then the hydrocarbon vapors are quenched as rapidly as possible to a temperature at which thermal cracking is essentially arrested.

The selective vaporization step involves very rapid vaporization and very short residence time of the hydrocarbon feed stock in the riser 1. This minimizes thermal cracking of the feed stock. The conventional method for calculating residence time in superficially similar FCC riser reactors is not well suited to the selective vaporization step. FCC residence times assume a large increase in number of mols of vapor as cracking proceeds up the length of the riser. Such effects are minimal in the selective vaporization step. Hence, for the selective vaporization step, hydrocarbon residence time (i.e., the time of contact between the feed stock and the contact material) is calculated as the length of the riser from the point where the feed stock and the contact material is separated from the hydrocarbon vapors (i.e., at the top of the riser), divided by the superficial linear velocity at the separation point. As so measured, the hydrocarbon residence time for the selective vaporization step should be less than 3 seconds. Since some minor thermal cracking of the portions of the feed stock, deposited on the contact material, particularly the high Conradson Carbon and metal-containing components of the feed stock, will take place at the preferred selective vaporization temperatures, the selective vaporization step can be improved by reducing as much as possible the hydrocarbon residence time. Thus a hydrocarbon residence time of less than 2 seconds is preferred, especially 0.5 second or less. The hydrocarbon residence time should, however, be long enough to provide adequate intimate contact between the feed stock and the contact material (e.g., at least 0.1 second).

As shown in FIG. 1, the contact material is introduced into the riser 1 at or near the bottom of the riser, preferably with a fluidizing medium, such as steam or water. The fluidizing medium transports the contact material up the riser 1 as the contact material heats the fluidizing medium. The feed stock is introduced at a point along the riser 1 which will insure a proper hydrocarbon residence time. Preferably, a volatile material, such as steam, water or a hydrocarbon, is added to, and mixed with, the feed stock in the riser 1. The volatile material serves to control (i.e., to decrease) the hydrocarbon residence time and also to reduce the partial pressure of hydrocarbons in the feed stock.

The feed stock can be preheated before it is introduced into the riser 1. The feed stock can be preheated to any temperature below thermal cracking temperatures, e.g., 200°-800° F., preferably 300°-700° F. Preheating temperatures higher than about 800° F. can induce thermal cracking of the feed stock with production of low octane naphtha.

The contact material is introduced into the riser 1 at a high temperature. Temperature of the contact material introduced into the riser is such that the resulting mixture of contact material and feed stock is at an elevated contact temperature which is upwards of 700° F. (up to about 1050° F.), preferably about 900°-1000° F. In this regard, the contact temperature of the mixture of feed stock and contact material should be high enough to vaporize most of the feed stock and its diluents (i.e., the fluidizing medium and the volatile material, if used). For a resid feed stock boiling above about 500°-650° F., a contact temperature of at least 900° F. will generally be sufficient. For a feed stock containing light ends, such as a whole crude or a topped crude, the contact temperature should be about 1050° F., preferably about 900°-1000° F. In this regard, the contact temperature of the mixture of feed stock and contact material should be high enough to vaporize most of the feed stock and its diluents (i.e., the fluidizing medium and the volatile material, if used). For a resid feed stock boiling above about 500°-650° F., a contact temperature of at least 900° F. will generally be sufficient. For a feed stock containing light ends, such as a whole crude or a topped crude, the contact temperature should be above the average boiling point of the feed stock as defined by Bland and Davidson, "Petroleum Processing Handbook"—that is, at a temperature above the sum of ASTM distillation temperatures from the 10 percent point to the 90 percent point, inclusive, divided by 9.

The pressure in the contactor A should, of course, be sufficient to overcome any pressure drops in the downstream equipment. In this regard, a pressure of 15-50 psi in the contactor A is generally sufficient.

During the very brief, high temperature contact of the contact material with the feed stock in the selective vaporization step, the majority of the heavy components of the feed stock having high Conradson Carbon residues and/or metal content and salts in the feed stock is deposited on the contact material. This deposition may be a coalescing of liquid droplets, adsorption, condensation or some combination of these mechanisms on the particles of the contact material. In any event, there appears to be little or no conversion of a chemical nature. Particularly, thermal cracking is minimal and is primarily restricted to the portions of the feed stock deposited on the contact material. What is removed from the feed stock by the contact material under preferred conditions is very nearly that indicated by the Conradson Carbon of the feed stock. Further, the hydrogen content of the deposits on the contact material is about 3-6%, below the 7-8% normal in FCC coke.

The hot contact material and any fluidizing medium, introduced at the bottom of the riser 1 of contactor A, move upwardly in the riser at high velocity, e.g., 40 feet per second or more as measured at the top of the riser. The hot contact material mixes rapidly with the feed stock and any volatile material in the riser and carries the feed stock and volatile material up the riser at high velocity. The feed rate and temperature of the hot contact material, as well as the fluidizing medium and the volatile material, are such in the riser that the resulting mixture is at a suitable elevated temperature to volatilize all or most of the components of the feed stock except the majority of its high Conradson Carbon and metal-containing compounds and its salts.

At the top of the riser 1 in the contactor A, the vaporized hydrocarbons are separated as rapidly as possible from the entrained contact material on which the high Conradson Carbon and metal-containing components, as well as any salts of the hydrocarbon feed stock, are deposited. This can be accomplished by discharging the hydrocarbon vapors and the contact material from the riser 1 into a large disengaging zone defined by vessel 3. However, it is preferred that the riser discharge directly into cyclone separators 4. As is well known in the FCC art, a plurality of cyclones 4 can be utilized. From the cyclones 4, hydrocarbon vapors are transferred to a vapor line 5, and contact material drops into the disengaging zone of vessel 3 by diplegs 6 and from there drops to stripper 7. In stripper 7, steam, admitted by line 8, displaces traces of volatile hydrocarbons from the contact material.

The hydrocarbon vapors from vapor line 5 of the contactor A are mixed with cold liquid hydrocarbons introduced by line 12 to arrest thermal cracking. The so-quenched hydrocarbons are then cooled in condenser 13 and passed to accumulator 14 from which gases are removed for further processing or for fuel. Condenser 13 can be suitably utilized as a heat exchanger to preheat the decarbonized, demetallized, and/or desalted hydrocarbons that are in accumulator 14 and that are to be charged to an FCC unit, generally C, as shown in FIG. 1 and described in U.S. Pat. No. 4,243,514.

Certain advantages can be realized in the pretreatment process, shown in FIG. 1, when no fluidizing medium is introduced into the riser 1 of the contactor A by using recycled hydrocarbons (e.g., hydrocarbons obtained by fractionating the hydrocarbon vapors from the contactor A in the column quencher, mentioned above) instead of recycled water (e.g., water from sump 15) or steam as the volatile material, introduced into riser 1. Using water or steam as the volatile material requires that the effluent of hydrocarbon vapors from the contactor A be cooled to the point of condensation of water, which in this water vapor/hydrocarbon vapor system is about 150° F. This results in relatively high losses in the valuable sensible heat and heat of condensation of the hydrocarbon vapors. When, however, recycled hydrocarbons are used as the volatile material, condensation of the effluent from the top of the riser can be accomplished at higher temperatures, resulting in much lower losses in the sensible heat and heat of condensation of the hydrocarbon vapors.

The liquid hydrocarbons in accumulator 14 are desalted, decarbonized and/or demetallized hydrocarbons, such as a resid, and comprise a satisfactory charge for an FCC process or for a hydroprocess. Preferably, part of the liquid hydrocarbons in accumulator 14 is used as the cold quench liquid in line 12, and the balance is transferred directly to the FCC unit C by line 16.

As shown in FIG. 1, the contact material bearing combustible deposits of high Conradson Carbon compounds and metal-containing compounds from the hydrocarbon feed stock passes from the stripper 7 in the contactor A by a standpipe 17 to the inlet 19 at the bottom of the burner B, used in the combustion step of the pretreatment process. In the burner B, the contact material contacts an oxidizing gas, such as air or oxygen, preferably air. The combustion step can be carried out in the burner B using, for example, any of the techniques suited to the regeneration of an FCC catalyst. Temperature in the dense phase of the burner is above about 1100° F., most usually in the range of about 1200° F. to 1500° F.

Combustion of the combustible deposits on the contact material to carbon monoxide, carbon dioxide or water vapor or to carbon dioxide and water vapor generates the heat required for the selective vaporization step when heated contact material is returned by the standpipe 2 to the riser 1 in the contactor A and is mixed with hydrocarbon feed stock, fluidizing medium and volatile material.

The burner B can be similar in construction and operation to any of the known FCC regenerators. The burner can be of the riser type with hot recycle as shown in FIG. 1 or can be of the older, dense fluidized bed type. The burner can include any of the known expedients for adjusting burner temperature, such as nozzles for burning torch oil in the burner to raise temperature or heat exchangers to reduce temperature.

As shown in FIG. 1, contact material, with its combustible deposits, passes from the stripper 7 of the contactor A to the burner inlet 19 via standpipe 17. At the burner inlet 19, the contact material from standpipe 17 meets, and mixes with, a rising column of an oxidizing gas, preferably air, introduced into the burner inlet 19. If desired, contact material may meet and mix with steam or water, introduced into the burner inlet 19. The presence of an ample supply of steam in the atmosphere of burner B is advantageous when equilibrium catalyst with added sintering agent is to be sintered in burner B.

At the burner inlet 19, the contact material from standpipe 17 also meets and mixes with hot contact material from burner recycle 20. The hot recycled contact material rapidly heats the fresh contact material to the 1100°–1500° F. temperature required for combustion of the deposits on the fresh contact material.

The mixture of fresh and recycled contact materials is carried upwardly from the burner inlet 19 to an enlarged zone 21 in the burner where the contact material forms a small fluidized bed in which thorough mixing and initial burning of the combustible deposits on the fresh contact material occur. The burning mass of contact material passes through a restricted riser 22 to discharge at 23 into an enlarged disengaging zone 24. The hot burned particles of contact material fall to the bottom of the disengaging zone 24. A part of the hot contact material enters recycle 20; another part enters the standpipe 2 for recycle to the riser after steam stripping. Another part is periodically withdrawn to maintain the activity of the contact material at a desired low level. This material may be discarded or treated for removal of metals and then recycled through A and B.

After the pretreatment of the hydrocarbon feed stock, the resulting decarbonized, desalted and/or demetallized hydrocarbons comprise a good quality feed stock for the FCC unit, indicated at C in the drawing. Hence, as shown in the figure, the hydrocarbons are transferred from the accumulator 14 by line 16 to an FCC reactor 31 which may be operated in a conventional manner. Hot regenerated catalyst is transferred from an FCC regenerator 32 by a standpipe 33 for addition to the reactor charge. Partially spent catalyst from FCC reactor 31 passes by a standpipe 34 to the regenerator 32, while cracked products leave reactor 31 by transfer line 35 to fractionation for recovery of gasoline and other products.

As shown in FIG. 2, a stream of equilibrium catalyst from regenerator 32 is withdrawn through a transfer and valve 37 and conveyed to storage hopper 38. By means of valve 39, the flow of equilibrium catalyst into the treatment reactor 40 can be regulated. Air injected into reactor 40 or the screw conveyor pictured in the diagram can be used to transport the catalyst. The treatment reactor is provided with a cooling zone if needed and a treatment zone where a solution of sintering agent from storage tank 41, suitably sodium borate or sodium silicate, is injected by nozzles 42 located in the treatment zone. Flow of solution is controlled by conventional valves 43. An optional heating zone is provided to facilitate the impregnation process as the third section of the treatment reactor. The treated equilibrium catalyst is conveyed to storage hopper 45 through line 48 and valve 44. As required by the selective vaporization process, such treated equilibrium catalyst can be fed into burner B by means of valve 46 where it meets and mixes with contact material from standpipe 17 and burner recycle 20 at the base of burner B.

In this embodiment of the invention the burner B preferably operates with a steam atmosphere and at a temperature above 1200° F., for example 1300° F. to 1500° F. Temperatures above 1500° F. may be used when the materials of construction of the burner do not preclude use of such temperature. Steam may be present as a result of water and/or steam addition to hydrocarbon feedstock and/or contact material introduced into contactor A, or by injection of steam or water into burner B. Steam enhances the effectiveness of most sintering agents whereby desired reductions in activity and surface area of equilibrium catalyst may be achieved at lower temperatures than those needed when heat treatment is carried out in the absence of steam.

EXAMPLES

The effect of processing and utilizing FCC equilibrium catalyst in the manner described has been demonstrated in laboratory scale (MAT) equipment. Charge in all of the tests was 1.2 grams of Mid-continent gas oil of 27° API gravity contacted with 6 grams of catalyst (or deactivated catalyst) during 48 second delivery time at 910° F. Catalyst to oil ratio was 5 at a WHSV of 15. Activity values obtained under these conditions are generally similar to those obtained under conditions described in the Bartholic patent. As used hereinafter in the specification and claims, microactivity values refer to those obtained using 6 grams of catalyst and 1.2 grams of gas oil.

Several experiments will be described with regard to specific embodiments of this invention but many variations of these practices are possible and are considered to be within the scope of this invention. For example, many types of chemical sintering agents or combinations thereof are possibilities in this process. In like manner, caustic treatment agents are numerous and are applicable in practice of this invention.

EXAMPLE 1

Samples of equilibrium HEZ-55 TM fluid cracking catalyst obtained from a commercial refinery and having a surface area of 184 $m^2/g$ were treated with aqueous solution of sodium borate, ($Na_2B_4O_7.10H_2O$) to 70% of the weight of the sample. Solutions of 14% and 28% (wt./wt.) concentration were used to provide two levels of addition of sodium borate. After drying, the samples were calcined in air at 1800° F. A sample of the untreated equilibrium catalyst was also calcined in air at 1800° F. as the control. The samples were then evaluated by a MAT procedure (duplicate runs) at conditions of C/O=5, WHSV=15, 910° F., reactor temperature. The results of these tests are summarized in Table I.

For comparison purposes, the MAT results are presented in Table I for fluidizable microspheres of calcined kaolin clay as described in the Bartholic patent.

TABLE I

Evaluations of Sodium Borate Treated Equilibrium Catalyst Sintered at 1800° F.

| Sample | Conversion Vol. % | Coke, Wt. % | $H_2$, Wt. % | BET Surface Area ($m^2/g$) | Pore* Volume cc/g |
|---|---|---|---|---|---|
| Eq. HEZ-55, Calcined at 1800° F. | 62.0 | 5.63 | 0.32 | 125 | 0.275 |
| Eq. HEZ-55 + 5 Wt. % $Na_2B_4O_7$, Calcined at 1800° F. | 11.2 | 1.96 | 0.12 | 28.7 | 0.149 |
| Eq. HEZ-55 + 10 Wt. % $Na_2B_4O_7$, Calcined at 1800° F. | 4.1 | 0.64 | 0.06 | 8.6 | 0.138 |
| Microspheres of Calcined Kaolin Clay (0.19% Na) | 11.5 | 0.98 | 0.05 | 9.7 | 0.295 |

*using $nC_{12}H_{26}$ as adsorbate

Data in Table I show that addition of sodium borate in amounts of 5% and 10% by weight caused a dramatic reduction in the catalytic cracking activity of the equilibrium catalyst as well as in the yields of coke and hydrogen. Equilibrium catalysts sintered with sodium borate had functional properties quite similar to the sample of calcined clay. Equilibrium catalyst calcined at 1800° F., without addition of sintering agent, produced undesirably high conversion of about 60% with relatively high coke and hydrogen formation. The data show also that impregnation with sodium borate resulted in significant sintering at 1800° F. Note the marked decreases in surface area and pore volume.

EXAMPLE 2

To 75 g of another sample of the same equilibrium HEZ-55 catalyst was added 250 g of 10% NaOH solution in a 500 ml round bottom flask in order to destroy the zeolite component and thereby reduce cracking activity. The mixture was refluxed for about 6 hours. After filtering off the mother liquor, the sample was thoroughly washed with water, oven dried and then calcined at 1200° F. for one hour. This sample along with the control sample similarly calcined, were evaluated by the MAT procedure at the standard conditions of C/O=5, WHSV=15, and 910° F. The results are summarized in Table II.

TABLE II

Evaluations of Caustic Leached Equilibrium Catalyst

| Sample | Conversion, Wt. % | Coke, Wt. % | $H_2$, Wt. % |
|---|---|---|---|
| HEZ-55, Calcined 1200° F. | 75.4 | 4.59 | 0.14 |
| HEZ-55 + 10% NaOH (aq)/Reflux Calcined, 1200° F. | 13.9 | 4.60 | 0.21 |
| Microspheres of Calcined Kaolin Clay | 11.5 | 0.98 | 0.05 |

A comparison of data in Table I with data in Table II shows that treatment with a 10% caustic solution under reflux and sintering at 1200° F. was less effective than sintering with sodium borate at 1800° F. A reduction in activity to a level only slighly greater than that of the microspheres of calcined clay as a result of the treatment with caustic was noted, but there was no decrease in coke or $H_2$ make. These data therefore show that activity of equilibrium cracking catalyst can be reduced to minimal levels but that the deactivated material may still be prone to produce undesirable coke and hydrogen.

EXAMPLE 3

This example demonstrates the utility of sodium silicate as a sintering agent in practice of the invention. Example 1 was repeated, substituting a solution of sodium disilicate containing 28.5 wt.% of $SiO_2$ concentration for the solution of sodium borate. This solution was further diluted as needed to insure uniform distribution. The quantity of sodium silicate added in one test corresponded to addition to about 5% $SiO_2$ (wt) and about 1.9% Na (wt). In another test about 10% $SiO_2$ and about 3.9% Na were added. Sintering temperature was 1800° F. Results for these tests and a control in which a sample of equilibrium HEZ-55 was calcined at 1800° F. appear in Table III.

TABLE III

Evaluations of Sodium Silicate Treated Equilibrium Catalyst Sintered at 1800° F.

| Sample | Conversion Vol % | Coke Wt. % | $H_2$ Wt. % | BET Surface Area $m^2/g$ | Pore Volume cc/g |
|---|---|---|---|---|---|
| Eq. HEZ-55, Calcined at 1800° F. | 62.0 | 5.63 | 0.32 | 125 | 0.25 |
| Eq. HEZ-55 + Sodium Silicate (5% $SiO_2$; 1.9% Na) | 15.9 | 3.21 | 0.13 | 56.0 | 0.175 |
| Eq. HEZ-55 + Sodium Silicate (10% $SiO_2$; 3.9% Na) | 5.16 | 1.69 | 0.05 | 14.0 | 0.141 |
| Microspheres of Calcined Kaolin Clay | 11.5 | 0.95 | 0.05 | 9.7 | 0.295 |

Data in Table III for sintering with about 7% sodium disilicate (5% $SiO_2$) at 1800° F. indicate a marked decrease in activity and moderate decrease in coke and hydrogen formation. As the level of sodium silicate was increased, there was increased sintering, reflected by further decreases in surface area and liquid pore volume; coke and hydrogen formation were decreased.

EXAMPLE 4

In Example 2, equilibrium catalyst was refluxed in sodium hydroxide solution and calcined at 1200° F., accomplishing considerable deactivation but without reduction in coke and hydrogen formation. The procedure was repeated but calcination was carried out at 1800° F. The sintered material contained 7.1 wt.% Na. Conversion was decreased to 7.5%; wt.% coke was 2.93; hydrogen was 0.03; surface area was 31.7 $m^2/g$. This sintered material was markedly superior to a similarly treated sample of the equilibrium catalyst sintered at a lower temperature.

EXAMPLE 5

Another sample of equilibrium HEZ-55 catalyst was impregnated with 6.34% Na by addition of a solution of sodium hydroxide of 20 wt.% concentration, followed by drying and calcination at 1800° F. MAT conversion was 4.4%; coke was 0.37 wt.%; $H_2$ was 0.1 wt.%; BET surface area was 5.6 $m^2/g$. Impregnation with sodium hydroxide and sintering at 1800° F. therefore resulted in an essentially inert, sintered equilibrium catalyst with minimal coke and hydrogen forming tendency.

EXAMPLE 6

The procedure of Example 5 was repeated with sodium nitrate, resulting in a sintered (1800° F.) material containing 5.1% Na. Conversion was 2.5%; coke was 0.64%; hydrogen was 0.03%; surface area 7.5%. Providing means are available for abating NOx emission problems, sodium nitrate would be an effective sintering reagent.

EXAMPLE 7

In previous examples of successful deactivation, sintering was carried out at 1800° F. by calcination in air. Similar tests were carried out using a sintering temperature of 1400° F. in air. For purposes of control, a sample of equilibrium HEZ-55 catalyst was calcined in air at 1400° F. In one case (sodium disilicate added at level of 10%) the calcination was carried out in an atmosphere of steam (100% steam) to permit comparison between air and steam atmospheres during sintering. Results are summarized in Table IV. Also reported into Table IV are results for impregnation with sodium chloride and sodium hydroxide.

TABLE IV

Thermal Deactivation of Treated Equilibrium Catalyst by Calcination or Steam Treatment at 1400° F.

| Sample | Conversion Vol. % | Coke Wt. % | $H_2$ Wt. % | BET $M^2/g$ | Pore Volume cc/g** |
|---|---|---|---|---|---|
| 1400° F. Calcination in Air | | | | | |
| HEZ-55 (eq.) (control) | 74.0 | 5.26 | 0.30 | 186 | 0.355 |
| HEZ-55 (eq.) + 10% $Na_2B_4O_7$ | 12.7 | 2.06 | 0.05 | 60.6 | 0.243 |
| HEZ-55 (eq.) + 10% $SiO_2$* (3.9% Na) | 10.8 | 2.23 | 0.04 | 44.0 | 0.187 |
| HEZ-55 (eq.) + 3.9% Na as NaCl | 15.4 | 3.47 | 0.06 | 142.0 | 0.289 |
| HEZ-55 (eq.) + 3.9% Na as NaOH | 12.1 | 3.14 | 0.10 | 79.0 | 0.266 |
| Microspheres of Calcined Kaolin | 11.5 | 0.98 | 0.05 | 9.7 | 0.295 |
| 1400° F. 100% Steam Treatment | | | | | |
| HEZ-55 (eq.) + 10% $SiO_2$* (3.9% Na) | 6.94 | 1.41 | 0.04 | 29.6 | 0.17 |
| HEZ-55 (eq.) + 10% $Na_2B_4O_7$ | 6.47 | 1.07 | 0.02 | 15.7 | 0.233 |
| HEZ-55 (eq.) + 3.9% Na as NaOH | 9.29 | 2.17 | 0.05 | 49.7 | 0.229 |

*Silica and sodium added as sodium disilicate
**determined by Mercury Porosimetry Data in Table IV indicate that sodium silicate and sodium borate treatments of equilibrium catalyst followed by treatment at 1400° F., a temperature feasible in burner B in the accompanying figure, resulted in deactivated equilibrium catalysts markedly superior with regard to inertness and coke make to equilibrium catalyst treated with equivalent amounts of sodium hydroxide. Sodium silicate and sodium borate resulted in slightly less hydrogen make.

A comparison of results for steam treatment at 1400° F. and air calcination at the same temperature indicate that steam was more effective in reducing surface area and coke yield but had no detectable effect on hydrogen make. The superior results obtained with sodium silicate and sodium borate over results for sodium hydroxide are again evident after steaming.

A correlation between surface area data in this (and other examples) and coke production indicate that reductions in surface area generally are correlated with reduction in coke yield but not necessarily hydrogen yield. Also shown by these data (especially results for NaCl addition, and 7% sodium silicate with 1800° F. sintering) is that activity can be reduced significantly but with minimal reduction in surface area, resulting in a material producing little hydrogen but much coke.

Also shown in the examples is that heat treatment of equilibrium catalyst at 1200° F.–1800° F. in the absence of a sintering agent did not deactivate the equilibrium catalyst to an activity level similar to that of calcined kaolin clay and that the heat treated equilibrium catalyst which did not contain a sintering agent produced large amounts of coke and hydrogen even when calcined at 1800° F.

Other potential variations of the above described methods of reducing the catalytic activity of equilibrium FCC catalysts are possible. For example, the process of the above invention could operate in a manner, such that a solution of fluxing agent could be sprayed into the upper dilute phase of burner B and equilibrium FCC catalyst from the cracking unit C could be added to burner B for hydrothermal deactivation and then be charged directly to the selective vaporization unit A without prior calcination.

We claim:

1. In a process for preparing premium products from petroleum hydrocarbon feedstock having a substantial Conradson Carbon number and metals content which comprises contacting said feed in a decarbonizing zone with a fluidizable solid material having a low microactivity for catalytic cracking at low severity, including a temperature of at least 900° F., for a period of time less than that which induces substantial thermal cracking of said feedstock, at the end of said period of time separating from said inert solid a decarbonized hydrocarbon fraction of reduced Conradson Carbon number and metals content as compared with said feedstock, reducing temperature of said separated fraction to a level below that at which substantial thermal cracking takes place, subjecting said inert solid after contact with said feedstock to air at elevated temperature in a separate burning zone to remove combustible deposit from said solid and heat the solid, and recycling at least a portion of said inert solid from the burning zone to the decarbonizing zone for further decarbonizing of said feedstock, the improvement which comprises utilizing as at least a portion of said fluidizable solid so recycled to the decarbonizing zone particles of equilibrium fluid cracking catalyst that have previously been treated by addition of a sintering agent followed by heating to sinter said particles, in order to reduce catalyst cracking activity and surface area without substantially increasing coke and hydrogen forming properties.

2. The process according to claim 1 wherein said feedstock is a residual fraction of petroleum obtained by fractionally distilling a crude petroleum to separate distillates from the residual fraction thus produced.

3. The process according to claim 1 wherein said feedstock is a residual fraction of petroleum obtained as the atmospheric bottoms product of conventional atmospheric distillation.

4. The process of claim 1 wherein equilibrium catalyst has a BET surface area below 100 $m^2/g$ after being treated to reduce activity and surface area.

5. The process according to claim 1 wherein said particles of equilibrium catalyst has been treated by addition of at least one sodium compound as sintering agent followed by heating to sinter said particles.

6. The process of claim 5 wherein said sodium compound is selected from the group consisting of sodium borate, sodium phosphate, sodium hydroxide, sodium nitrate and sodium silicate.

7. The process of claim 6 wherein said particles are sintered at a temperature in the range of about 1200° F. to 2000° F.

8. The process according to claim 7 wherein said particles are sintered in the presence of steam in said burning zone.

9. The process of claim 5 wherein said equilibrium catalyst containing said added sodium compound is introduced into said burning zone and said burning zone includes a steam atmosphere and is at a temperature above 1200° F., whereby said equilibrium catalyst containing said sodium compound is treated to reduce activity and surface area in said burning zone.

10. In a process for preparing premium products from crude petroleum by fractionally distilling the crude petroleum to separate gasoline and distillate gas oil from a residual fraction having a substantial Conradson Carbon number and metals content and charging the distillate gas oil to catalytic cracking in a cyclic fluid catalytic cracking unit using a fluid zeolitic cracking catalyst and withdrawing equilibrium cracking catalyst, which process comprises;

(a) contacting said residual fraction in a rising confined vertical column with an inert solid material having a low surface area and a low microactivity for catalytic cracking at low severity, including a temperature of at least about 900° F., for a period of time less than that which induces substantial thermal cracking of said residual fraction, (b) at the end of said period of time separating from said inert solid a decarbonized hydrocarbon fraction of reduced Conradson Carbon number and metals content as compared with said residual fraction, (c) reducing temperature of the said separated fraction to a level below that at which substantial thermal cracking takes place, (d) adding said decarbonized hydrocarbon to said distillate gas oil as additional charge to said catalytic cracking, (e) subjecting said inert solid separated from said decarbonized hydrocarbon fraction and now containig a combustible deposit to air at elevated temperature in a burner to remove said combustible deposit, and thereby heat the inert solid, (f) separating heated inert solids from hot vapors produced in step (e), (g) cycling at least a portion of said separated hot inert solid from steps (e) to (a); and, (h) at least periodically withdrawing metal loaded inert solid from step (e) without cycling it to step (a);

the improvement which comprises:

(i) adding at least one sintering agent to at least a portion of said withdrawn equilibrium catalyst, (j) heating the product of step (i) at a temperature and for a time sufficient to reduce microactivity below about 20 and surface area below about 50 $m^2/g$; and, (k) introducing at least a portion of the product of step (j) to said rising column in step (a) for cycling to steps (b), (c), (e) and (g).

11. The process of claim 10 wherein said sintering agent is a sodium compound.

12. The process of claim 11 wherein said sintering agent is selected from the group consisting of sodium borate, sodium phosphate, sodium hydroxide, sodium nitrate and sodium silicate.

13. In a process for preparing premium products from crude petroleum by fractionally distilling the crude petroleum to separate gasoline and distillate gas oil from a residual fraction having a substantial Conradson Carbon number and metals content and charging the distillate gas oil to catalytic cracking in the presence of a zeolitic cracking catalyst by;

(a) contacting said residual fraction in a rising confined vertical column with fluidizable particles which are catalytically inert or substantially so under conditions of elevated temperature and short contact time such as to avoid substantial thermal cracking of said residual fraction and selectivity vaporize hydrocarbons and deposit hydrocarbons contributing to Conradson Carbon number on said fluidizable particles, (b) at the end of said period of time separating from said particles of inert material now having a deposit of hydrocarbon and metals from a decarbonized hydrocarbon fraction of reduced Conradson Carbon number as compared with said residual fraction, (c) reducing temperature of the separated hydrocarbon fraction to a level below that at which substantial thermal cracking takes place, (d) adding said decarbonized hydrocarbon to said distillate gas oil as additional charge to said catalytic cracking, (e) burning combustibles from said particles of said inert material in a burner operated with lower dense phase comprising said particles and a hot upper gaseous phase include water vapor to remove said combustible deposit and thereby heat the inert solid, (f) separating hot gases from the burning of combustibles from hot inert solids in said burner, and (g) recycling at least a portion of said hot inert solids into contact with further charge of said residual fraction, (h) regenerating zeolitic cracking catalyst from catalytic cracking of distillate gas oil in a regenerator separate from the burner used in step (e), and;

(i) periodically withdrawing equilibrium cracking catalyst from said regenerator used in step (h) in order to maintain desired catalytic cracking activity and selectivity of said circulating inventory of cracking catalyst, the improvement which comprises:

(j) applying a sintering agent to at least a portion of said withdrawn equilibrium cracking catalyst, and heating said catalyst with added sintering agent to reduce catalytic activity and surface area, and cycling the resulting material into contact with further change of said residual fraction in step (a).

14. The process of any one of claims 1, 10 or 13, wherein said sintering agent is an alkali or alkaline earth metal c nnpound.

15. T e process of any one of claims 1, 10 or 13, wherein said sintering agent is employed in an amount between about 1% to about 20% by weight relative to said equilibrium catalyst.

* * * * *

UNITED STATES PATENT AND TRADEMARK OFFICE

CERTIFICATE OF CORRECTION

PATENT NO. : 4,384,949

DATED : May 24, 1983

INVENTOR(S) : Reagan et al.

It is certified that error appears in the above—identified patent and that said Letters Patent is hereby corrected as shown below:

Column 2, line 26 - "additionm" should be -- addition --.

Column 6, line 25 - "feedback" should be -- feedstock --.

Signed and Sealed this

*Twenty-third* Day of *August 1983*

[SEAL]

*Attest:*

GERALD J. MOSSINGHOFF

*Attesting Officer*

*Commissioner of Patents and Trademarks*